US011376858B2

(12) United States Patent
Koehler et al.

(10) Patent No.: US 11,376,858 B2
(45) Date of Patent: Jul. 5, 2022

(54) STATUSES OF FILL PORTS

(71) Applicant: Hewlett-Packard Development Company, L.P., Spring, TX (US)

(72) Inventors: Duane A Koehler, Vancouver, WA (US); Tyler Phillip Kapp, Vancouver, WA (US); Kenneth Williams, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 93 days.

(21) Appl. No.: 17/049,143

(22) PCT Filed: Jul. 13, 2018

(86) PCT No.: PCT/US2018/042029
§ 371 (c)(1),
(2) Date: Oct. 20, 2020

(87) PCT Pub. No.: WO2020/013856
PCT Pub. Date: Jan. 16, 2020

(65) Prior Publication Data

US 2021/0237459 A1 Aug. 5, 2021

(51) Int. Cl.
*B41J 2/175* (2006.01)
*B41J 2/21* (2006.01)

(52) U.S. Cl.
CPC ..... *B41J 2/17509* (2013.01); *B41J 2/17546* (2013.01); *B41J 2/2103* (2013.01)

(58) Field of Classification Search
CPC ..... B41J 2/17509
See application file for complete search history.

(56) References Cited

U.S. PATENT DOCUMENTS

| | | | |
|---|---|---|---|
| 5,675,367 | A | 10/1997 | Scheffelin |
| 5,828,389 | A | 10/1998 | Yamaguchi et al. |
| 6,050,667 | A | 4/2000 | Yamada |
| 6,520,612 | B1 | 2/2003 | Merz et al. |
| 7,029,104 | B2 | 4/2006 | Sakai et al. |
| 7,364,252 | B2 | 4/2008 | Asauchi |
| 8,215,754 | B2 | 7/2012 | Akiyama |
| 8,465,137 | B2 | 6/2013 | Fujikawa et al. |
| 2009/0153614 | A1 | 6/2009 | Karppinen |
| 2010/0182385 | A1 | 7/2010 | Steinmetz |
| 2010/0302313 | A1 | 12/2010 | Smith |

FOREIGN PATENT DOCUMENTS

| | | | | |
|---|---|---|---|---|
| EP | 2039520 | B2 | 1/2018 | |
| WO | WO-2020013861 | A1 * | 1/2020 | ..... B41J 2/175 |

* cited by examiner

*Primary Examiner* — Justin Seo
(74) *Attorney, Agent, or Firm* — HP Inc. Patent Department

(57) ABSTRACT

In some examples, a controller may include a processing resource and a memory resource storing non-transitory machine-readable instructions that are executed to cause the processing resource to direct a clock signal of an imaging device to a fill port via a detection circuit of the imaging device, determine based on a state of a switch included in the detection circuit whether the fill port is open or closed, determine based on the state of the switch indicating the fill port is closed a status of the fill port, and in response to the status of the fill port being closed, determine based on a voltage of the clock signal whether the fill port is connected to a colorant container.

15 Claims, 4 Drawing Sheets

STATUSES OF FILL PORTS

BACKGROUND

Imaging systems, such as printers, copiers, etc., may be used to form markings on a physical medium, such as text, images, etc. In some examples, imaging systems may form markings on the physical medium by performing a print job. A print job can include forming markings such as text and/or images by transferring a print substance (e.g., ink, toner, etc.) to the physical medium.

DETAILED DESCRIPTION

Figure 1:
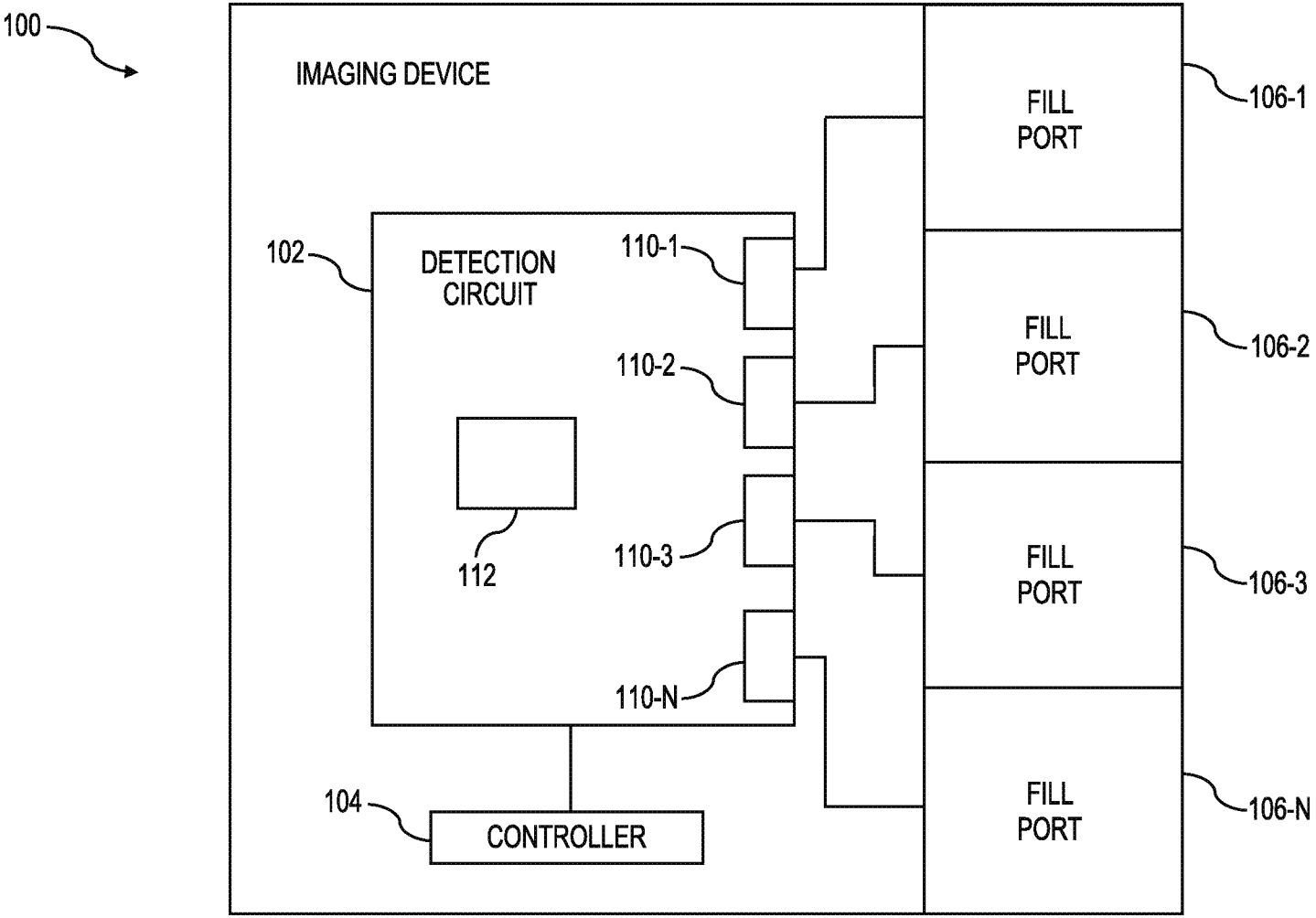
FIG. 1 illustrates an example imaging device consistent with the disclosure.

Imaging devices may include a supply of a print substance located in a reservoir. The print substance can be deposited onto a physical medium. As used herein, the term "imaging device" refers to any hardware device with functionalities to physically produce representation(s) (e.g., text, images, models, etc.) on a medium. In some examples, a "medium" may include paper, photopolymers, plastics, composite, metal, wood, or the like.

The reservoir including the print substance may be inside of the imaging device and contain a supply of the print substance such that the imaging device may draw the print substance from the reservoir as the imaging device creates the physical representations on the print medium. As used herein, the term "reservoir" refers to a container, a tank, and/or a similar vessel to store a supply of the print substance for use by the imaging device.

An imaging device may include more than one reservoir such that various types (e.g., various colors) of print substance may be contained within the imaging device. Each reservoir containing the print substance may be connected to a fill port such that a user may fill the reservoir as the supply of print substance is used by the imaging device. As used herein, the term "fill port", refers to an aperture, an area, and/or other opening connected to a print substance reservoir that receives a print substance and transfers the received print substance to the print substance reservoir (e.g., to replenish the print substance supply) included in the imaging device.

Each fill port may be accessible from the exterior of the imaging device such that a user may access the fill port to fill and/or re-fill the reservoir with the appropriate print substance as the volume of the print substance in the reservoir decreases. In some imaging devices, each fill port may include a corresponding fill port cover. As used herein, the term "fill port cover", may refer to an object that may obstruct a fill port, an aperture, an area, and/or an opening such that the fill port is obstructed. The fill port cover can protect the contents of the reservoir from the external environment.

A fill port cover may be opened in order to transfer print substance to the print substance reservoir. In some examples, a fill port cover may be left open after filling and/or refilling the reservoir. While the fill port cover can prevent a print substance from evaporating and/or becoming contaminated (e.g., by dust or other contaminants), a fill port cover having been left open may lead to the print substance evaporating and/or being contaminated. In other words, when a fill port cover is left in an open position, the print substance may be exposed to external elements which may have a detrimental effect on the print substance performance and/or the fill port assembly.

Some imaging devices may not include reservoirs that indicate a type of print substance in the reservoir or how much print substance is in the reservoir. Thus, when the user attempts to fill a reservoir with a supply of the print substance, a potential for error (e.g., overfilling, refill of the wrong type, etc.) can exist. In other examples, some imaging devices may include multiple print substance reservoirs each having corresponding fill ports. An imaging device with multiple reservoirs result in tedious and complex print substance filling operations.

Statuses of fill ports according to the disclosure can include a detection circuit to detect a status of each fill port included on the imaging device. As used herein, the term "fill port status" refers to a condition of the fill port. The condition of the fill port can include being open or being closed. The fill port can be closed via the fill port cover or via a colorant container being connected to the fill port. As used herein, the term "colorant container" can refer to a vessel, bottle, bag, box, carton, or other suitable receptacle for the transfer and/or containment of a print substance. The colorant container can be used to fill or refill a reservoir connected to the fill port, as is further described herein.

The detection circuit can provide a scheme to unambiguously determine the fill port status of the fill ports included in an imaging device. The detection circuit may include a mechanical and/or electronic switch electrically connected at each fill port to detect when a fill port is open or closed (e.g., by a fill port cover or having a colorant container connected thereto). The detection circuit may provide a signal to a controller of the imaging device, and the imaging device may provide instructions to a user via a user interface regarding the detected status. The instructions provided to the user can help the user to determine whether the reservoir is full of print substance, whether print substance should be added to the reservoir, whether a supply of the print substance is connected to a correct fill port to deliver a correct type of print substance to a corresponding reservoir, and/or a fill port status including whether the fill port is open or closed, among other types of instructions.

FIG. 1 illustrates an example imaging device consistent with the disclosure. As illustrated in FIG. 1, an imaging device 100 may include a detection circuit 102, a controller 104, a plurality of fill ports 106-1, 106-2, 106-3, 106-N (referred to collectively as fill ports 106), plurality of switches 110-1, 110-2, 110-3, 110-N (referred to collectively as switches 110), and pull-down resistor 112.

The imaging device 100 can include fill ports 106. The plurality of fill ports 106 may be used to fill and/or refill a reservoir with a print substance that can be utilized by the imaging device 100, as described above. Although not shown in FIG. 1 for clarity and so as not to obscure examples of the disclosure, the imaging device 100 may include a corresponding reservoir connected to each fill port of the plurality of fill ports 106.

Each of the fill ports 106 can include a fill port cover. For example, as described above, the fill port cover can cover a fill port such that the print substance included in a reservoir connected to the fill port does not evaporate and/or become contaminated. However, in order to perform a fill operation for the reservoir, the fill port cover can be removed to expose a fill port. The fill port cover of each of the fill ports 106 can include a resistor. As used herein, the term "resistor" refers to an electrical component of a circuit that engenders electrical resistance (e.g., to restrict or reduce current flow).

The resistor of each fill port cover can have a different resistance value. For example, the fill port cover of fill port 106-1 can include a resistance value that is different than the fill port covers of fill ports 106-2, 106-3, 106-N, etc. In some examples, the resistor of the fill port cover of fill port 106-1 can be 50 k Ohms, the resistor of the fill port cover of fill port 106-2 can be 100 k Ohms, the resistor of the fill port cover of fill port 106-3 can be 200 k Ohms, and the resistor of the fill port cover of fill port 106-N can be 400 k Ohms, although examples of the disclosure are not so limited to the above resistance values.

As the print substance included in the reservoir is utilized by imaging device 100, the amount of print substance included in the reservoirs can be depleted. A fill operation may be performed to fill and/or re-fill the amount of print substance in the reservoirs. During a fill operation (e.g., the activity of a user or machine filling the reservoir with a print substance), a user may open a fill port cover to expose one of the fill ports 106.

When one of the plurality of fill port covers is opened to expose a fill port, a switch (e.g., switches 110) electrically connected to the fill port cover can be opened. For example, as a result of a fill port cover being opened to expose fill port 106-1, switch 110-1, which is electrically connected to fill port 106-1, can be opened. In other words, a state of the switch 110 can be changed.

As illustrated in FIG. 1, imaging device 100 can include detection circuit 102. As used herein, the term "detection circuit" refers to an electrical circuit which can be utilized to determine a state of a fill port. For example, detection circuit 102 can be utilized to determine whether fill ports 106 are open or closed. In an example in which fill ports 106 are closed, detection circuit 102 can be utilized to determine whether fill ports 106 are closed via fill port covers or have colorant containers connected thereto. As illustrated in FIG. 1, detection circuit 102 can include switches 110 and pull-down resistor 112, as is further described herein.

As used herein, the term "switch" refers to an electrical component which can break an electrical circuit, such as interrupting a current in the electrical circuit and/or diverting the current from one component to another. For example, when the fill port cover of fill port 106-1 is opened, switch 110-1 corresponding to fill port 106-1 can be opened, causing a change in the state of the switch 110-1. As used herein, the term "switch state" refers to a condition of the switch. A condition of the switch 110 can include an open switch state or a closed switch state. As used herein, the term "open state" refers to a condition in which the switch has interrupted a current in the electrical circuit including the switch. As used herein, the term "closed state" refers to a condition in which current can pass through the electrical circuit including the switch. For example, when the fill port cover of fill port 106-1 is opened, the switch 110-1 can change from closed (e.g., in which current is flowing through switch 110-1) to open (e.g., in which switch 110-1 interrupts a flow of current to fill port 106-1.

As described above, the switch state of switch 110-1 can be closed when a fill port cover of fill port 106-1 is closed, protecting the print fluid in the reservoir connected to fill port 106-1 from evaporating or from contaminants. However, examples of the disclosure are not so limited. For example, the switch state of switch 110-1 can be closed when a colorant container is connected to fill port 106-1, as is further described herein.

The controller 104 can perform a detection process to determine a state of fill ports 106. As used herein, the term "detection process" refers to a process to determine whether a fill port is open, whether a fill port is closed via a fill port cover, and/or whether a fill port is closed via a colorant container.

The controller 104 can perform the detection process by connecting a clock signal of imaging device 100 to a first fill port 106-1 of the fill ports 106 via detection circuit 102. As used herein, the term "clock signal" refers to a signal that oscillates between a high and a low state at a particular frequency. In some examples, the clock signal can be generated by a dock generator included in imaging device 100, although examples of the disclosure are not limited to a clock generator. In some examples, the clock signal can be an i2C clock signal. As used herein, the term "i2C" refers to a serial communications protocol. The clock signal can be multi-purpose. In some examples, the clock signal can be utilized to read a colorant container acumen to determine information related to the contents, manufacturing, etc. of the colorant container, as is further described in connection with FIG. 3C. In some examples, the dock signal can be utilized as a general-purpose input. The voltage of the general-purpose input clock signal can be measured by an analog-to-digital (ADC) converter, or by other means. The measured voltage can be transmitted to controller 104, as is further described herein.

The controller 104 can determine the state of first switch 110-1. For example, controller 104 can determine whether first switch 110-1 is open or closed. Based on the state of first switch 110-1, controller 104 can determine whether fill port 106-1 is open or closed, as is further described herein.

In one example, controller 104 can determine that fill port 106-1 is open. Controller 104 can determine that fill port 106-1 is open based on the state of switch 110-1. For example, controller 104 can determine that switch 110-1 is in an open state. Switch 110-1 being in an open state can correspond to switch 110-1 having interrupted a current in the electrical circuit including switch 110-1.

Based on the open state of switch 110-1, controller 104 can determine that fill port 106-1 is open. That is, the open state of switch 110-1 can correspond to fill port 106-1 being open. Since switch 110-1 is in an open state, controller 104 can determine that fill port 106-1 is open. For example, as described above, a user can remove the fill port cover of fill port 106-1, which can cause switch 110-1 to be in an open state, allowing controller 104 to determine the fill port cover of fill port 106-1 has been removed.

In another example, controller 104 can determine that fill port 106-1 is closed. Controller 104 can determine that fill port 106-1 is closed based on the state of switch 110-1. For example, controller 104 can determine that switch 110-1 is in a closed state. Switch 110-1 being in a closed state can correspond to switch 110-1 allowing current to pass through the electrical circuit including switch 110-1.

Based on the closed state of switch 110-1, controller 104 can determine that fill port 106-1 is closed. That is, the closed state of switch 110-1 can correspond to fill port 106-1 being closed. Since switch 110-1 is in a closed state, controller 104 can determine that fill port 106-1 is closed.

As described above, fill port 106-1 can be closed in two ways. In one example, fill port 106-1 can be closed via a fill port cover. In another example, fill port 106-1 can also be closed as a result of a colorant container being connected to fill port 106-1. Controller 104 can determine whether the fill port 106-1 is closed via the fill port cover or via the colorant container being connected to fill port 106-1, as is further described herein.

Controller 104 can measure the voltage of the clock signal to determine whether fill port 106-1 is closed via a fill port cover or via a colorant container being attached. As used herein, the term "voltage" refers to a difference in electric potential between two points of an electrical circuit. Controller 104 can measure the voltage of the clock signal at switch 110-1 to determine whether fill port 106-1 is closed via a fill port cover or via a colorant container being connected thereto. For example, the voltage of the clock signal can be measured by an ADC and utilized by controller 104 to determine whether fill port 106-1 is closed.

Controller 104 can determine that fill port 106-1 is closed via a colorant container in response to the voltage of the clock signal being a first voltage. For example, controller 104 can measure the voltage of the clock signal to be 0 volts (V). Based on the voltage of the clock signal being 0V, controller 104 can determine that fill port 106-1 has a colorant container connected thereto.

As described above, the first voltage can be a first voltage. The first voltage can be a predetermined voltage (e.g., 0V). The first voltage can be a predetermined voltage of 0V which can indicate that a colorant container is connected to fill port 106-1. Although the first voltage is described above as being 0V, examples of the disclosure are not so limited. For example, the first voltage can be any other predetermined voltage. For example, the first voltage can be 1V, or a voltage less than 1V or higher than 1V.

As illustrated in FIG. 1, detection circuit 102 can include a pull-down resistor 112. For example, pull-down resistor 112 can cause the voltage of the clock signal of imaging device 100 to be the predetermined first voltage when the colorant container is connected to and covering fill port 106-1. In other words, pull-down resistor 112 can cause the voltage of the clock signal of imaging device 100 to be the first voltage of 0V when the colorant container is connected to and covering fill port 106-1. The pull-down resistor 112 can be part of a resistor-divider network that can either pull-down the voltage to reference ground potential or pull-up the voltage to any other arbitrary value. The pull-down resistor 112 can establish a default signal voltage when the clock signal is serving as a voltage input and fill port 106 is not closed by a fill port cover. The pull-down resistor 112 and resistors included on fill port covers of each fill port 106 can form a voltage divider circuit. Controller 104 can utilize the voltage resulting from the voltage divider circuit to determine a fill port status, as is further described herein.

In some examples, pull-down resistor 112 can be a 10K ohm resistor. However, examples of the disclosure are not limited to a 10K ohm resistor. For instance, pull-down resistor 112 can be a resistor having a higher resistance than 10K ohms (e.g., 11K ohms) or a resistor having a lower resistance than 10K ohms (e.g., 9K ohms).

Controller 104 can determine that fill port 106-1 is closed via a fill port cover in response to the voltage of the clock signal being a second voltage. As described above, the fill port cover corresponding to fill port 106-1 can include a resistor having, for instance, a resistance value of 50 k Ohms. When the fill port cover having the 50 k Ohm resistor is connected to fill port 106-1, the 50 k Ohm resistor can be connected to detection circuit 102, forming a voltage divider with pull-down resistor 112. As a result of the voltage divider, controller 104 can measure the voltage of the clock signal to be 3.3 volts (V). For example, pull-down resistor 112 can cause the voltage of the clock signal to be 3.3V when a fill port cover is connected to and covering fill port 106-1. Based on the voltage of the clock signal being 3.3V, controller 104 can determine that fill port 106-1 has a fill port cover connected thereto.

As described above, the second voltage can be a second voltage. The second voltage can be a predetermined voltage (e.g., 3.3V). The second voltage can be a predetermined voltage of 3.3V which can indicate that a fill port cover is connected to fill port 106-1. Although the second voltage is described above as being 3.3V, examples of the disclosure are not so limited. For example, the second voltage can be any other predetermined voltage. For example, the second voltage can be 2V, or a voltage less than 2V, or a voltage higher than 2V. The second predetermined voltage can be included in a table of predetermined voltage values, as is further described herein.

Controller 104 can perform the detection process sequentially for each fill port of the fill ports 106. For example, once controller 104 has determined that fill port 106-1 is either open, closed via a fill port cover, or closed via a colorant container being connected thereto, controller 104 can determine whether fill port 106-2 is open, closed via a fill port cover, or closed via a colorant container being connected thereto, whether fill port 106-3 is open, closed via a fill port cover, or closed via a colorant container being connected thereto, whether fill port 106-N is open, closed via a fill port cover, or closed via a colorant container being connected thereto, etc.

For instance, in response to fill port 106-2 being closed, controller 104 can perform the detection process by directing the clock signal of imaging device 100 to fill port 106-2 via the detection circuit 102. Controller 104 can measure the voltage of the clock signal at switch 110-2, which is electrically connected to fill port 106-2, to determine whether fill port 106-2 is closed via a fill port cover or via a colorant container being connected thereto. The clock signal can be an input signal to detection circuit 102, and controller 104 can measure the voltage of the clock signal using an ADC, among other ways to measure the voltage of the clock signal.

Fill port 106-2 can be determined to be closed via a colorant container. For example, controller 104 can measure the voltage of the clock signal to be a first voltage, where the first voltage corresponds to a colorant container being attached to fill port 106-2. As described above, the first voltage can be 0V. For example, controller 104 can measure the voltage of the clock signal to be 0V and as a result, determine that a colorant container is connected to fill port 106-2. In some examples, controller 104 can additionally query a memory device connected to the colorant container to confirm the presence of the colorant container. Based on controller 104 receiving a signal from the memory device (e.g., a colorant container acumen) as a result of the query, controller 104 can determine that a colorant container is connected to fill port 106-2.

Fill port 106-2 can be determined to be closed via a fill port cover. As described above, the fill port cover corresponding to fill port 106-2 can include a resistor having, for instance, a resistance value of 100 k Ohms. When the fill port cover having the 100 k Ohm resistor is connected to fill port 106-2, the 100 k Ohm resistor can be connected to detection circuit 102, forming a voltage divider with pull-down resistor 112. As a result of the voltage divider, controller 104 can measure the voltage of the clock signal to be a second voltage, where the second voltage corresponds to a fill port cover being attached to fill port 106-2. As described above, the second voltage can be 5V. For example, controller 104 can measure the voltage of the clock signal to be 5V and as a result, determine that a fill port cover is connected to fill port 106-2.

In some examples, more than one fill port cover may be connected to fill ports 106. For example, a fill port cover including a resistor having a resistance value of 50 k Ohms can be connected to fill port 106-1 and a fill port cover including a resistor having a resistance value of 200 k Ohms can be connected to fill port 106-3. As a result of the fill port cover being connected to fill port 106-1 and the fill port cover being connected to fill port 106-3, the 50 k Ohm resistor and the 200 k Ohm resistor can be connected to the detection circuit 102, forming a voltage divider with pull-down resistor 112. As a result of the voltage divider, controller 104 can measure the voltage of the clock signal to be a predetermined voltage. For example, pull-down resistor 112 can cause the voltage of the clock signal to be 10V when a fill port cover is connected to and covering fill port 106-1 and when a fill port cover is connected to and covering fill port 106-3. Based on the voltage of the clock signal being 10V, controller 104 can determine that fill port 106-1 and fill port 106-3 have fill port covers connected thereto. In other words, controller 104 can compare the measured clock signal voltage with a table of predetermined values to determine which fill ports 106 are closed via fill port covers.

The table of predetermined values can include all combinations of voltages corresponding to all combinations of fill ports 106 being closed by fill port covers based on the resistance values of the resistors included in each fill port cover. For example, imaging device 100 can include four fill ports 106-1, 106-2, 106-3, 106-N. As a result, a total of sixteen combinations of fill port statuses of closed via fill port covers are possible. Each of the sixteen combinations can include a unique predetermined voltage value that controller 104 can compare the voltage of the clock signal against to determine which fill ports 106 are closed via fill port covers.

For example, Table 1 (below) illustrates combinations of fill ports 106 being closed via fill port covers. Controller 104 can compare the clock signal voltage to the predetermined table of voltage values to determine which fill ports 106 are closed via fill port covers.

TABLE 1

| Fill Port Status 1 = Closed 0 = Open | | | | |
|---|---|---|---|---|
| 106-1 | 106-2 | 106-3 | 106-N | Predetermined Value |
| 0 | 0 | 0 | 0 | 0 |
| 0 | 0 | 0 | 1 | 8 |
| 0 | 0 | 1 | 0 | 16 |
| 0 | 0 | 1 | 1 | 24 |
| 0 | 1 | 0 | 0 | 32 |
| 0 | 1 | 0 | 1 | 40 |
| 0 | 1 | 1 | 0 | 48 |
| 0 | 1 | 1 | 1 | 56 |
| 1 | 0 | 0 | 0 | 64 |
| 1 | 0 | 0 | 1 | 72 |
| 1 | 0 | 1 | 0 | 80 |

TABLE 1-continued

| Fill Port Status 1 = Closed 0 = Open | | | | |
|---|---|---|---|---|
| 106-1 | 106-2 | 106-3 | 106-N | Predetermined Value |
| 1 | 0 | 1 | 1 | 88 |
| 1 | 1 | 0 | 0 | 96 |
| 1 | 1 | 0 | 1 | 104 |
| 1 | 1 | 1 | 0 | 112 |
| 1 | 1 | 1 | 1 | 120 |

The predetermined values illustrated above in Table 1 can, in some examples, be an arbitrary value assigned to each voltage combination, each voltage-divider ratio, or in some examples, can be actual voltages or voltage divider ratios. The predetermined values are illustrative and, as a result, examples of the disclosure are not so limited to the above predetermined values in Table 1. In some examples, the predetermined number illustrated in Table 1 can correspond to a voltage. For example, the predetermined value of 80 may correspond to a voltage of 5V. That is, controller 104 can measure a clock signal voltage to be 5V (e.g., caused by a voltage divider formed from pull-down resistor 112 and the resistors corresponding to the fill port covers connected to the particular fill ports), determine 5V to correspond to a predetermined value of 80, and using Table 1, determine that a fill port cover is connected to fill port 106-1 and a fill port cover is connected to fill port 106-3. In other examples, the predetermined value of 80 may correspond to a particular voltage divider ratio.

Statuses of fill ports according to the disclosure can detect a status of a plurality of fill ports. A detection circuit included in an imaging device may protect the imaging device and print substance included in reservoirs contained therein by alerting a user to the status of the fill port as being open, closed via a fill port cover, or closed via a colorant container being connected thereto. In this way, the integrity of the fill ports and the print substance may be monitored and maintained.

Figure 2:
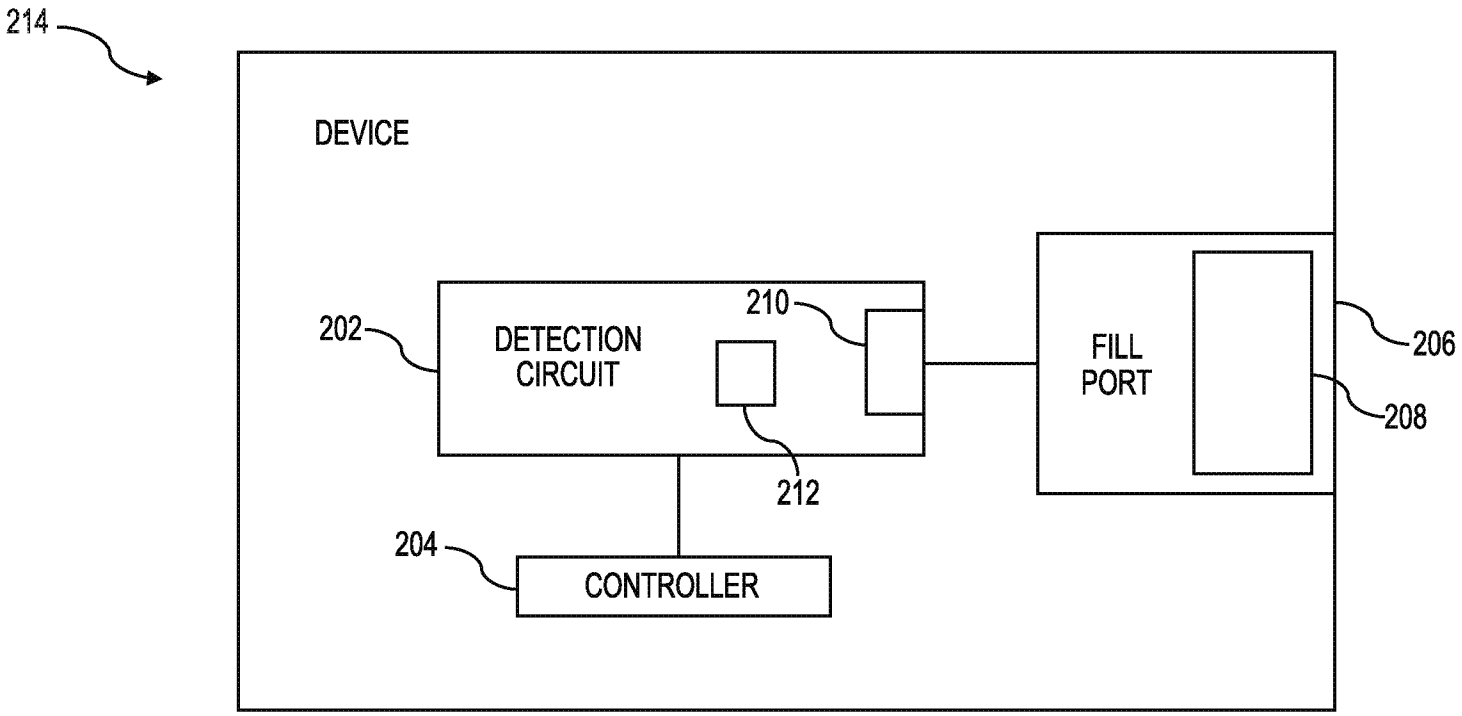
FIG. 2 illustrates an example device consistent with the disclosure.

FIG. 2 illustrates an example device 214 consistent with the disclosure. As illustrated in FIG. 2, a device 214 may include a detection circuit 202, a controller 204, a fill port 206, a fill port cover 208, pull-down resistor 212, and a switch 210.

As illustrated in FIG. 2, device 214 can include a detection circuit 202. The detection circuit 202 can include a switch 210. Switch 210 can be electrically connected to fill port 206.

Device 214 can further include a controller 204. Controller 204 can perform a detection process, as is further described herein.

For example, controller 204 can direct a clock signal of device 214 to fill port 206 via switch 210 and detection circuit 202. The clock signal can, in some examples, be generated by a clock generator included in device 214. Using the voltage of the clock signal, controller 204 can determine whether fill port 206 is open, closed via a fill port cover 208, or closed via a colorant container using the detection process described herein. Controller 204 can direct the clock signal to fill port 206 via switch 210 via firmware control and/or via a general purpose input/output signal.

Controller 204 can determine whether fill port 206 is open or closed. Fill port 206 can be open when a reservoir including a print substance has to be filled or refilled. For instance, a user may remove a fill port cover 208 in order to fill or refill a reservoir with print substance. Although not illustrated in FIG. 2 for clarity and so as not to obscure examples of the disclosure, the reservoir can be connected to fill port 206.

Controller 204 can determine whether fill port 206 is open or closed based on a state of switch 210. When switch 210 is in an open state (e.g., having interrupted a current in the electrical circuit), controller 204 can determine that fill port 206 is open. For example, a user may have removed fill port cover 208 in order to fill or refill the reservoir with print substance. When switch 210 is in a closed state (e.g., allowing current to pass through the electrical circuit including the switch), controller 204 can determine that fill port 206 is closed. However, controller 204 has not yet determined how fill port 206 is closed (e.g., the status of fill port 206). That is, the status of fill port 206 can indicate how fill port 206 is closed. For instance, fill port 206 can be closed via a fill port cover 208 or via a colorant container.

In response to the status of fill port 206 being closed, controller 204 can determine whether fill port 206 is connected to a colorant container. Controller 204 can determine whether fill port 206 is connected to a colorant container by determining the voltage of the clock signal. For example, if controller 204 determines the voltage of the clock signal to be a first voltage (e.g., 0V as a result of pull-down resistor 212), controller 204 can determine that a colorant container is connected to fill port 206. Although not illustrated in FIG. 2, a colorant container can be connected to fill port 206 which can cause the voltage of the clock signal to be the first voltage.

In response to the status of fill port 206 being closed, controller 204 can determine whether fill port 206 is connected to a fill port cover 208. Controller 204 can determine whether fill port 206 is connected to the fill port cover 208 by determining the voltage of the clock signal. For example, if controller 204 determines the voltage of the clock signal to be a second voltage (e.g., 3.3V as a result of pull-down resistor 212), controller 204 can determine that fill port cover 208 is connected to fill port 206.

Figure 3C:
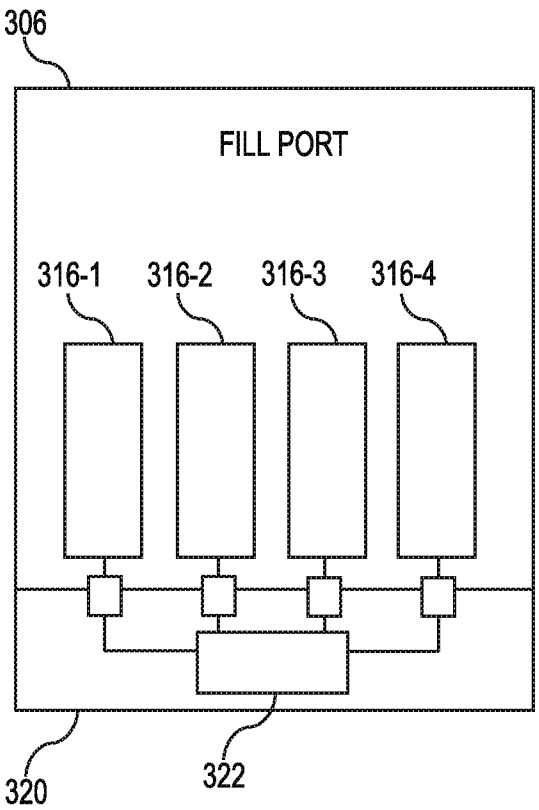
FIG. 3C illustrates an example fill port including a colorant container consistent with the disclosure.
Figure 3B:
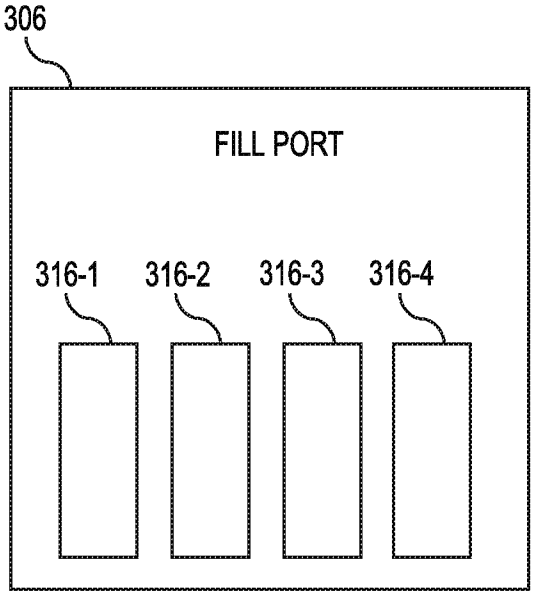
FIG. 3B illustrates an example fill port consistent with the disclosure.
Figure 3A:
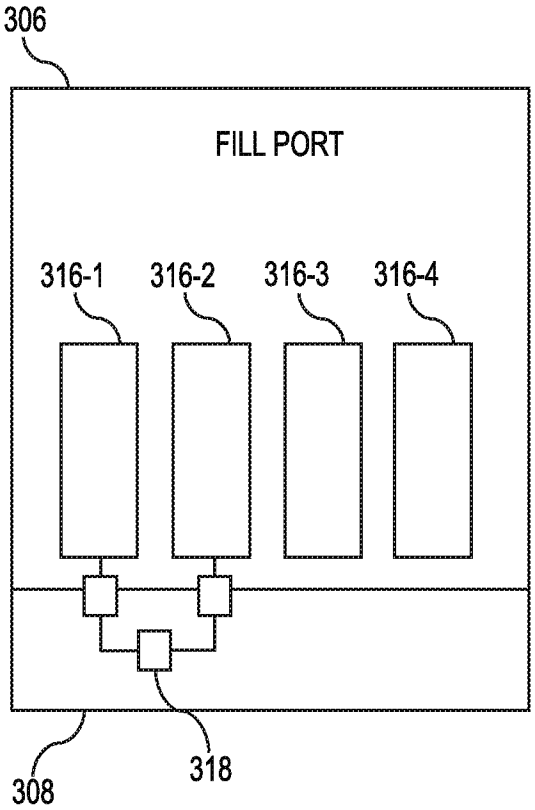
FIG. 3A illustrates an example fill port including a fill port cover consistent with the disclosure.

FIG. 3A illustrates an example fill port including a fill port cover consistent with the disclosure. As illustrated in FIG. 3A, fill port 306 can include a plurality of contacts 316-1, 316-2, 316-3, 316-4 (referred to collectively as contacts 316). Fill port cover 308 can include resistor 318.

As previously described in connection with FIGS. 1 and 2, fill port 306 can be open, closed via a fill port cover (e.g., fill port cover 308), or closed via a colorant container being connected thereto. As illustrated in FIG. 3A, fill port 306 can be closed. Fill port 306 can be closed via fill port cover 308. In other words, fill port cover 308 can be connected to fill port 306 in order to prevent the print substance located in a reservoir connected to fill port 306 from evaporating and/or becoming contaminated.

As a result of fill port cover 308 being connected to fill port 306, a resistor 318 can be connected to electrical contacts 316. As used herein, the term "contacts" refers to an electrical circuit component comprising an electrically conductive material such that the material may communicatively couple to another electrical circuit component. As used herein, the term "communicatively coupled" refers to various wired and/or wireless connections between devices such that data and/or signals may be transferred in various directions between the devices. For example, resistor 318 can be connected to contacts 316-1 and 316-2 to allow current to flow between contacts 316-1 and 316-2. In an example in which fill port 306 is open, resistor 318 is disconnected from contacts 316-1 and 316-2, as is further described in connection with FIG. 3B. Disconnecting resistor 318 can remove resistor 318 from the detection circuit (e.g., detection circuit 102, 202, previously described in connection with FIGS. 1 and 2, respectively).

Although not illustrated in FIG. 3A for clarity and so as not to obscure examples of the disclosure, fill port 306 can be electrically connected to a switch. In the example illustrated in FIG. 3A, the switch can be in a closed state. In other words, current can flow between the electrical contact 316-1, resistor 318, electrical contact 316-2, and the switch. In the closed state illustrated in FIG. 3A, a controller (e.g., controller 104, 204, previously described in connection with FIGS. 1 and 2, respectively) can determine that the fill port 306 is in a closed state via fill port cover 308 being connected to fill port 306.

FIG. 3B illustrates an example fill port consistent with the disclosure. As illustrated in FIG. 3B, fill port 306 can include a plurality of contacts 316-1, 316-2, 316-3, 316-4 (referred to collectively as contacts 316).

As illustrated in FIG. 3B, fill port 306 can be open. In other words, fill port 306 is not connected to a fill port cover, nor is fill port 306 connected to a colorant container.

As a result of neither a fill port cover or a colorant container attached to fill port 306, the switch connected to fill port 306 can be in an open state. For example, no current can flow between any of the electrical contacts 316. As a result, the switch can be in an open state.

FIG. 3C illustrates an example fill port including a colorant container consistent with the disclosure. As illustrated in FIG. 3A, fill port 306 can include a plurality of contacts 316-1, 316-2, 316-3, 316-4 (referred to collectively as contacts 316). Colorant container 320 can include colorant container acumen 322.

As a result of fill colorant container 320 being connected to fill port 306, colorant container acumen 322 can be connected to electrical contacts 316. As used herein, the term "colorant container acumen" refers to a memory device which can be attached to colorant container 320. For example, colorant container acumen 322 may be attached to colorant container 320 and include information related to the contents, manufacturing etc. of the colorant container.

Although not illustrated in FIG. 3C for clarity and so as not to obscure examples of the disclosure, fill port 306 can be electrically connected to a switch. In the example illustrated in FIG. 3C, the switch can be in a closed state. In other words, current can flow between the electrical contacts 316, colorant container acumen 322, and the switch. In the closed state illustrated in FIG. 3C, a controller (e.g., controller 104, 204, previously described in connection with FIGS. 1 and 2, respectively) can determine that the fill port 306 is in a closed state via colorant container 320 being connected to fill port 306.

In some examples, the controller can probe fill port 306 to query colorant container acumen 322 that may be attached to colorant container 320. For example, the controller can probe colorant container acumen 322 to determine information related to the contents, manufacturing, etc. of the print substance included in colorant container 320.

In some examples, the presence of the colorant container 320 at fill port 306 may be further verified by the controller collecting data about the colorant container 320. The controller can probe fill port 306 and if colorant container 320 is present, a detection circuit (e.g., detection circuit 102, 202, previously described in connection with FIGS. 1 and 2, respectively) may transmit data related to the colorant container 320 from colorant container acumen 322 to the controller. In this way, the detection circuit may communicate this data to the imaging device to be used to provide guidance to a user. For example, the imaging device can tell a user the colorant container 320 is installed correctly/incorrectly, whether the colorant container 320 includes a correct or incorrect type of print substance, an amount of print substance in the reservoir connected to the fill port 306, among other guidance.

Figure 4:
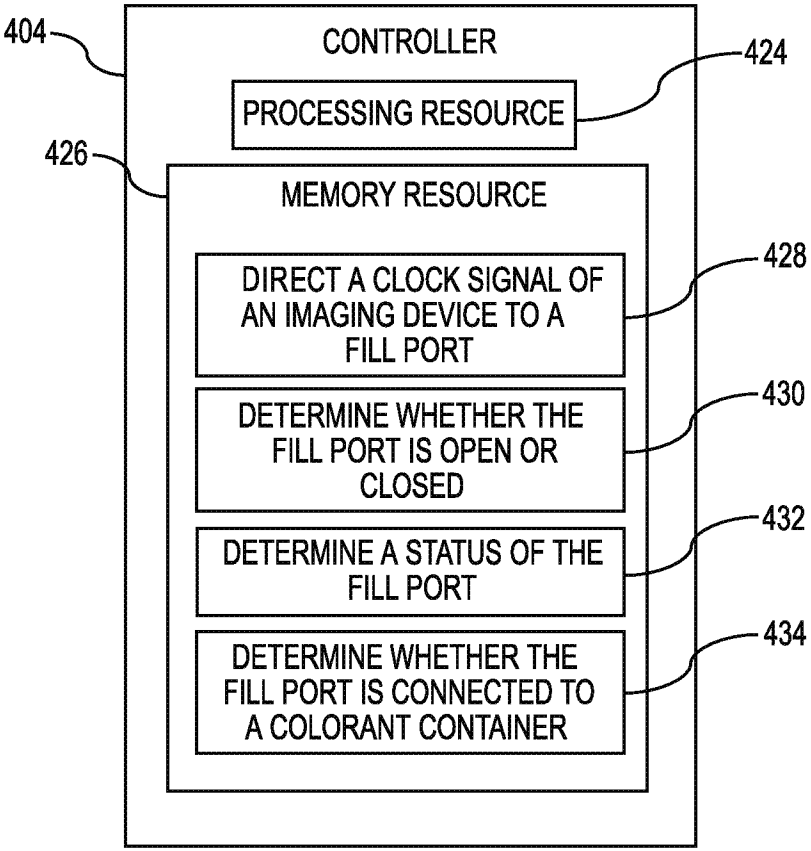
FIG. 4 illustrates an example of a controller consistent with the disclosure.

FIG. 4 illustrates an example controller 404 consistent with the disclosure. As illustrated in FIG. 4, the controller 404 may include a processing resource 424, and a memory resource 426. As used herein, the processing resource 424 may be a central processing unit (CPU), a semiconductor-based microprocessor, and/or other hardware devices suitable for retrieval and execution of instructions stored in non-transitory computer readable medium (e.g., the memory resource 426). The processing resource 424 may fetch, decode, and execute instructions 428, 430, 432, 434. As an alternative or in addition to retrieving and executing instructions, the processing resource 424 may include an electronic circuit that includes electronic components for performing the functionality of instructions. As used herein, the memory resource 426 may also be referred to a non-transitory computer readable medium, and may be a volatile memory (e.g., RAM, DRAM, SRAM, EPROM, EEPROM, etc.) and/or non-volatile memory (e.g., a HDD, a storage volume, data storage, etc.) Although the following descriptions refer to a single processor and a single memory, the descriptions may also apply to a system with multiple processors and multiple memories. In such examples, the instructions may be distributed (e.g., stored) across multiple memories and the instructions may be distributed (e.g., executed by) across multiple processors.

The controller 404 may include instructions 428 stored in the memory resource 426 and executable by the processing resource 424 to direct a clock signal of an imaging device to a fill port. That is, processing resource 424 can execute instructions 428 stored in the memory resource 426 to direct a clock signal of an imaging device to a fill port via a detection circuit of the imaging device. Using the voltage of the clock signal, controller 404 can determine whether the fill port is open, closed via a fill port cover, or closed via a colorant container, as is further described herein.

The controller 404 may include instructions 430 stored in the memory resource 426 and executable by the processing resource 424 to determine whether the fill port is open or closed. That is, processing resource 424 can execute instructions 430 stored in the memory resource 426 to determine, based on the state of a switch included in the detection circuit, whether the fill port is open or closed. When the switch is in an open state, controller 404 can determine that the fill port is open. For example, a user may have removed a fill port cover in order to fill or refill a reservoir connected to the fill port with print substance. When the switch is in a closed state, the controller 404 can determine that the fill port is closed.

The controller 404 may include instructions 432 stored in the memory resource 426 and executable by the processing resource 424 to determine a status of the fill port. That is, processing resource 424 can execute instructions 432 stored in the memory resource 426 to determine, based on the state of the switch indicating the fill port is closed, a status of the fill port. The status of the fill port can indicate how the fill port is closed. For example, the fill port can be closed via a fill port cover or via a colorant container. Therefore, the fill port status can refer to the fill port being closed via the fill port cover or being closed via the colorant container.

The controller 404 may include instructions 434 stored in the memory resource 426 and executable by the processing resource 424 to determine whether the fill port is connected to a colorant container. That is, processing resource 424 can execute instructions 434 stored in the memory resource 426 to, in response to the status of the fill port being closed, determine based on a voltage of the clock signal whether the fill port is connected to a colorant container. For example, controller 404 can determine whether the fill port is connected to a colorant container by determining the voltage of the dock signal. If controller 404 determines the voltage of the clock signal to be a first voltage (e.g., 0V), controller 404 can determine that a colorant container is connected to the fill port.

In some examples, the controller 404 may include further instructions stored in the memory resource 426 and executable by the processing resource 424 to determine whether the fill port is connected to a fill port cover. For example, controller 404 can determine whether the fill port is connected to a fill port cover by determining the voltage of the clock signal. If controller 404 determines the voltage of the clock signal to be a second voltage (e.g., 3.3V), controller 404 can determine that a fill port cover is connected to the fill port.

Statuses of fill ports according to the disclosure can detect a status of a plurality of fill ports. Utilizing a detection circuit and a controller, an imaging device can guide and/or alert a user to the status of the fill port as being open, closed via a fill port cover, or closed via being connected to a colorant container. In this way, the integrity of the fill ports and the print substance may be monitored and maintained. The determined status of the fill ports may be used by the imaging device to protect the reservoir, as well as the print substance included therein, from environmental elements such as evaporation and/or contaminants. Further, the controller may cause this information to be communicated to a user via a user interface to provide guidance or warning regarding a status of a fill port.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. Similar elements or components between different figures may be identified by the use of similar digits. For example, 102 may reference element "02" in FIG. 1, and a similar element may be referenced as 202 in FIG. 2.

Elements illustrated in the various figures herein can be added, exchanged, and/or eliminated so as to provide a plurality of additional examples of the disclosure. In addition, the proportion and the relative scale of the elements provided in the figures are intended to illustrate the examples of the disclosure and should not be taken in a limiting sense. As used herein, the designator "N", particularly with respect to reference numerals in the drawings, indicates that a plurality of the particular feature so designated can be included with examples of the disclosure. The designators can represent the same or different numbers of the particular features. Further, as used herein, "a plurality of" an element and/or feature can refer to more than one of such elements and/or features.

The above specification, examples and data provide a description of the method and applications and use of the system and method of the present disclosure. Since many examples can be made without departing from the spirit and scope of the system and method of the present disclosure, this specification merely sets forth some of the many possible example configurations and implementations.

What is claimed:

1. A controller, comprising:

a processing resource; and a memory resource storing non-transitory machine-readable instructions that are executed to cause the processing resource to:

direct a clock signal of an imaging device to a fill port via a detection circuit of the imaging device;

determine, based on a state of a switch included in the detection circuit, whether the fill port is open or closed;

determine, based on the state of the switch indicating the fill port is closed, a status of the fill port; and in response to the status of the fill port being closed, determine based on a voltage of the clock signal whether the fill port is connected to a colorant container.

2. The controller of claim 1, wherein the instructions are executed to cause the processing resource to determine the fill port is connected to the colorant container based on the voltage of the clock signal being a first voltage.

3. The controller of claim 1, wherein, in response to the status of the fill port being closed, determine whether the fill port is connected to a fill port cover.

4. The controller of claim 3, wherein the instructions are executed to cause the processing resource to determine the fill port is connected to the fill port cover based on the voltage of the clock signal being a second voltage.

5. The controller of claim 1, wherein:

the state of the switch includes a closed state; and in the closed state, a resistor included on a fill port cover corresponding to the fill port is connected to the detection circuit.

6. The controller of claim 5, wherein the closed state of the switch corresponds to the fill port being closed.

7. The controller of claim 1, wherein:

the state of the switch includes an open state; and in the open state, a resistor included on a fill port cover corresponding to the fill port is disconnected from the detection circuit.

8. The controller of claim 7, wherein the open state of the switch corresponds to the fill port being open.

9. A device, comprising:

a fill port cover corresponding to a fill port of the device;

a detection circuit including a switch, wherein the switch is electrically connected to the fill port; and a controller to:

direct a clock signal of the device to the fill port via the detection circuit;

determine, based on a state of the switch, whether the fill port is open or closed;

determine, based on the state of the switch indicating the fill port is closed, a status of the fill port;

in response to the status of the fill port being closed, determine the fill port is connected to a colorant container in response to a voltage of the clock signal being a first voltage; and in response to the status of the fill port being closed, determine the fill port is connected to the fill port cover in response to the voltage of the clock signal being a second voltage.

10. The device of claim 9, wherein the detection circuit includes a pull-down resistor.

11. The device of claim 10, wherein, in response to the fill port being closed, the pull-down resistor causes the voltage of the clock signal to be the first voltage when the colorant container is connected to the fill port.

12. The device of claim 10, wherein, in response to the fill port being closed, a resistor included in the fill port cover and the pull-down resistor form a voltage divider causing the voltage of the clock signal to be the second voltage when the fill port cover is connected to the fill port.

13. An imaging device, comprising:

a plurality of fill ports, wherein each fill port of the plurality of fill ports includes a respective fill port cover;

a detection circuit, wherein the detection circuit includes:

a plurality of switches, wherein each respective switch of the plurality of switches is electrically connected to respective fill ports of the plurality of fill ports; and a pull-down resistor;

a controller to perform a detection process, wherein the controller performs the detection process by:

connecting a clock signal of the imaging device to a first fill port of the plurality of fill ports via the detection circuit;

determining, based on a state of a first switch of the plurality of switches that is electrically connected to the first fill port, whether the first fill port is open or closed;

in response to the first fill port being closed, determining the first fill port is connected to a colorant container in response to a voltage of the clock signal being a first voltage; and in response to the status of the first fill port being closed, determining the first fill port is connected to a fill port cover in response to the voltage of the clock signal being a second voltage.

14. The imaging device of claim 13, wherein the controller is to perform the detection process sequentially for each fill port of the plurality of fill ports.

15. The imaging device of claim 13, wherein, in response to a second fill port of the plurality of fill ports being closed, the controller performs the detection process by:

connecting the clock signal to the second fill port via the detection circuit;

in response to the second fill port being closed, determining the second fill port is connected to a colorant container in response to a voltage of the clock signal being a first voltage; and in response to the status of the second fill port being closed, determining the second fill port is connected to a fill port cover in response to the voltage of the clock signal being a second voltage.

* * * * *